United States Patent [19]

Kipp et al.

[11] 4,102,484

[45] Jul. 25, 1978

[54] LEAKAGE RESISTANCE CARTON

[75] Inventors: Michael A. Kipp, Phoenixville; Richard T. Walter, Norristown, both of Pa.

[73] Assignee: Container Corporation of America, Chicago, Ill.

[21] Appl. No.: 793,777

[22] Filed: May 4, 1977

[51] Int. Cl.[2] ..... B65D 5/24; B65D 3/00

[52] U.S. Cl. ..... 229/16 A

[58] Field of Search ..... 229/37, 16 A, 21

[56] References Cited

U.S. PATENT DOCUMENTS

| | | | |
|---|---|---|---|
| 1,690,586 | 11/1928 | Main | 229/16 A UX |
| 2,138,700 | 11/1938 | Hoff, 3rd | 229/16 A UX |
| 3,120,335 | 2/1964 | Egleston et al. | 229/17 G X |
| 3,743,169 | 7/1973 | Person | 229/16 A X |
| 4,020,988 | 5/1977 | Kipp | 229/16 A |

*Primary Examiner*—Davis T. Moorhead

*Attorney, Agent, or Firm*—Carpenter & Ostis

[57] ABSTRACT

A tubular paperboard carton has a side wall, a bottom wall, and gussets foldably attached to said walls. The side wall is formed from a pair of panels at least one of which has a recess on its edge. The recess is interposed between a gusset and an edge of the other of said side wall forming panels when the carton is erected. A spot of adhesive is applied at the juncture of the gussets.

3 Claims, 6 Drawing Figures

LEAKAGE RESISTANCE CARTON

BACKGROUND OF THE INVENTION

1. Field of the Invention

This invention relates to a carton and, more particularly, to a paperboard carton having leakage resistant characteristics.

2. The Prior Art

Generally, paperboard cartons have been found to be unsatisfactory for packaging of powdered or fine granulated products due to leakage at various juncture points of the paperboard. To prevent leakage an inner bag or liner had to be used. The present invention overcomes the disadvantages of the prior art and provides a leakage resistant paperboard carton suitable for packaging of powdered or similar materials without the use of an inner liner or bag.

SUMMARY OF THE INVENTION

A tubular carton has a side wall formed from a pair of side wall forming panels, a bottom wall, and gussets foldably joined to the walls. A recess is formed along an edge of at least one of the side wall forming panels and is interposed between a gusset and an edge of the other of said side wall forming panels when the carton is erected. Adhesive is applied to the side wall forming panels to form the side wall. Adhesive is applied in the area of juncture of gussets to prevent leakage at that point.

DRAWING

SPECIFICATION

Figure 1:
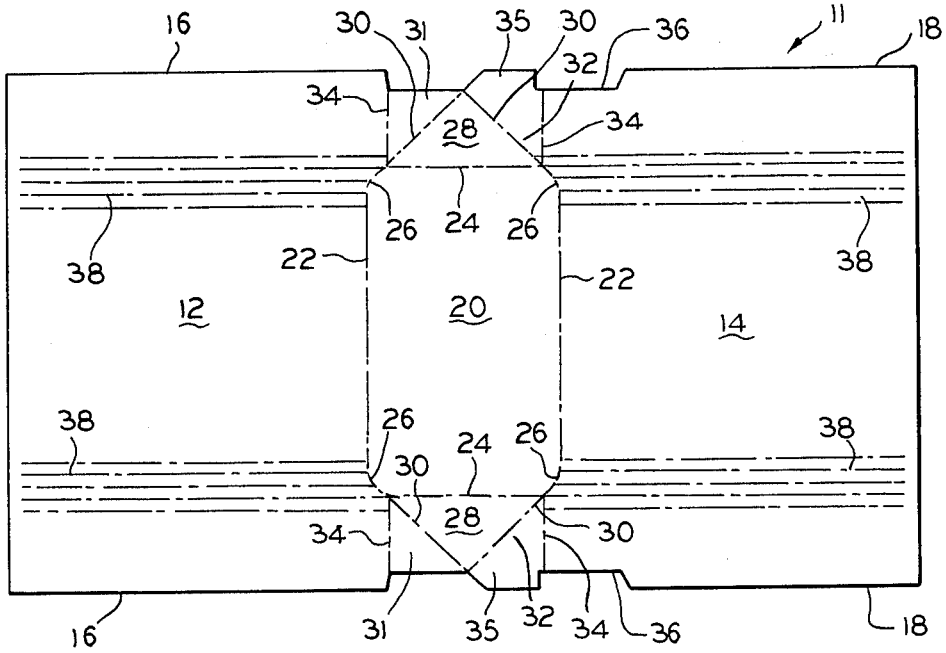
FIG. 1 is a plan view of a blank used to form a carton of the first embodiment of the present invention.

Referring now to the drawing, more specifically to FIGS. 1 through 4, there is shown a carton, generally designated 10, comprising a first embodiment of the present invention. The carton 10 is formed from a suitably scored and cut blank 11 of paperboard, or the like.

The carton 10 has a side wall formed from a pair of side wall formed from a pair of side wall forming panels 12 and 14. A bottom wall forming panel 20 is foldably secured to the side wall forming panels 12 and 14 along fold lines 22. Longitudinal fold lines 24 which are substantially normal to the fold lines 22 and which join the fold lines 22 at juncture points comprising common rounded corners 26, foldably secured the bottom wall panel 20 to a first gusset panel 28 having a triangular configuration.

The first gusset panel 28 is foldably attached along fold lines 30 to a pair of second gusset panels 31 and 32 which also have triangular configurations. The gusset panels 31 and 32 are hinged to the side wall forming panels 12 and 14 along respective fold lines 34. The panel 32 may have a tab 35 extending outwardly from its free edge.

The panel 14 has a pair of recesses or notches 36 which greatly simplify application of adhesive to the carton when the carton is formed from the blank 11. The provision of the recesses 36 permits single line applications of adhesive 17 applied along inner marginal edges of the panel 12 to secure the overlapping edges 16 of panel 12 to the underlying edges 18 of the panel 14.

At the same time, a portion of the adhesive 17 will contact the outer surface of the tab 35 securing a portion of the inner marginal edges of the panel 12 to the underlying tabs 35. In the absence of the tab 35, the adhesive pattern 17 would come in contact with the underlying first gusset panel 28.

Figure 2:
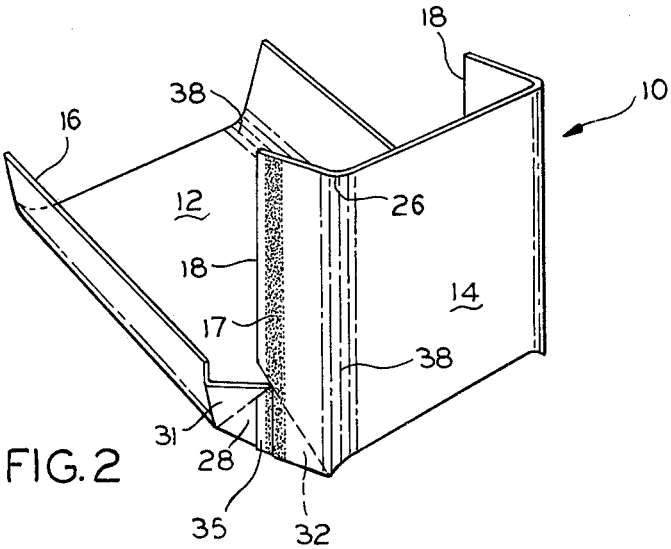
FIG. 2 is a perspective view of a partially erected carton formed from the blank of FIG. 1.
Figure 4:
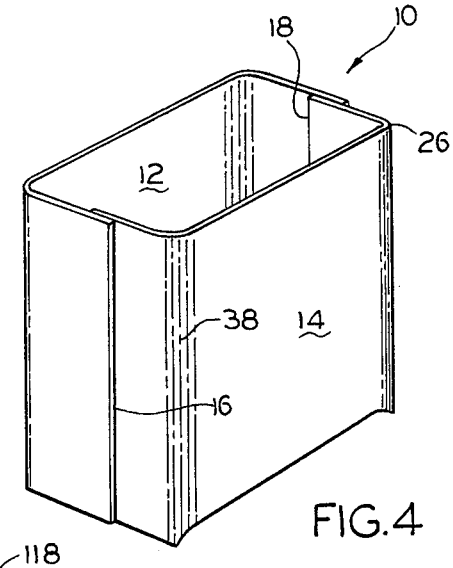
FIG. 4 is a perspective view of an erected carton formed from the blank of FIG. 1.

An alternative to applying the adhesive line 17 to the inner marginal edges of the panel 12 would be to apply it to the outer marginal edges of the panel 14 and to the adjacent exposed portion of the tab 35, as best seen in FIG. 2.

Figure 3:
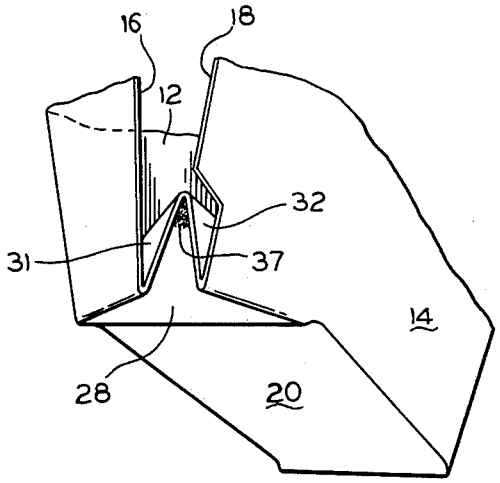
FIG. 3 is a further perspective view of a partially erected carton.

A spot of adhesive 37 is applied in the area of a point common to all gusset panels 28, 31 and 32. When the carton is being erected, as best seen in FIG. 3, the adhesive 37 secures the second gusset panels 31 and 32 to the first gusset panel 28. A certain amount of adhesive from the spot 37 is squeezed out between the adjacent free edges of second gusset panels 31 and 32 to come in contact with, and become secured to the inner marginal edge of the overlying panel 12 to effectively close off a source of possible leakage from the carton.

In the alternative arrangement which includes the tab 35 positioned off the free edge of the second gusset panels 32 as best seen in FIG. 2, the adhesive 17 secures the tab 35 to the first gusset panel 28.

Figure 5:
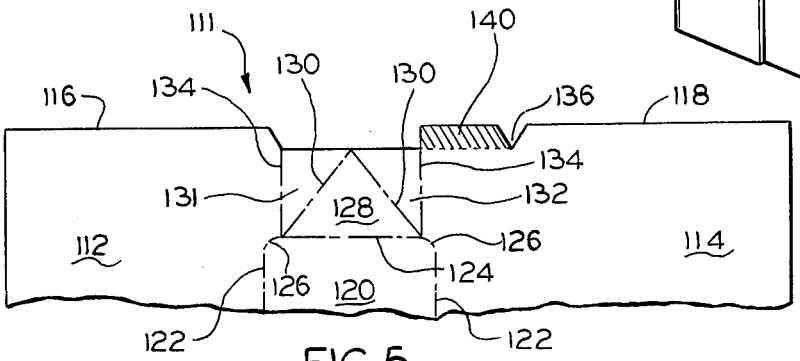
FIG. 5 is a plan view of a portion of a blank representing another embodiment of the present invention.
Figure 6:
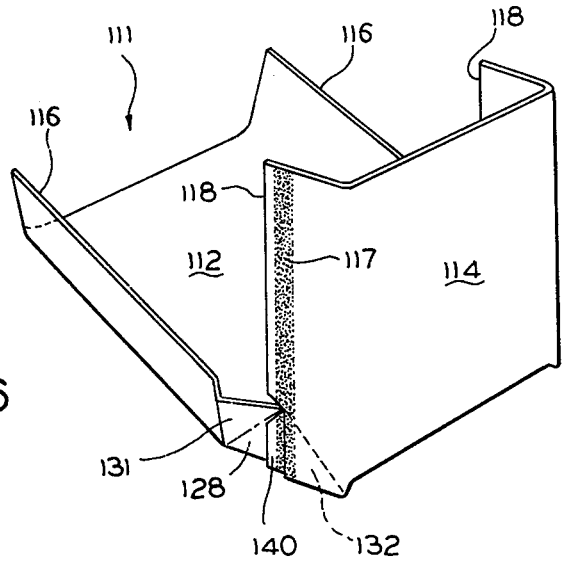
FIG. 6 is a perspective view of a partially erected carton formed from the blank of FIG. 5.

FIGS. 5 and 6 illustrate a carton blank 111 and a carton 110, respectively, representing another embodiment of the present invention. Like elements have been designated with the same numerals as used with respect to the first embodiment except that the numerals have been increased by 100.

Generally, the recess 136 has a different configuration from that of the recess 36. A tab 140 is similar to the tab 35 except that it has a debossed surface and extends from an edge of the side wall panel 114 immediately adjacent the recess 136 rather than from an edge of one of the gusset panels, as was the case with the first embodiment.

The effect of the recess 136 and the tab 140 is the same as heretofore described relative to the recess 36 and the tab 35.

It is certainly within the scope of this invention to provide a carton with flat rather than curved bottom. To attain this end, the fold lines 22 and 24 meet at substantially right angles so that the common corners 26 are no longer rounded.

We claim:

1. A tubular carton formed from a cut and scored blank of paperboard, or the like, said carton comprising:

(a) a side wall formed from a pair of generally rectangular side wall panels having their edges secured in an overlapped relationship;

(b) a bottom wall foldably secured at opposite side edges to bottom edges of said side wall panels along fold lines;

(c) a first gusset panel foldably secured to said bottom wall along a longitudinal fold line substantially normal to said fold lines between said bottom wall and said side wall panels;

(d) a pair of second gusset panels each foldably secured along diverging fold lines to said first gusset panels and to a respective one of said side wall panels;

(e) a recess formed along an edge of at least one of said side wall panels and interposed between a gusset panel and an edge of the other one of said pair of said side wall penels when said carton is in erected condition;

(f) a spot of adhesive applied in the area of a point common to said first gusset panel and each of said pair of said second gusset panels.

2. A carton as defined in claim 1, wherein one of said pair of second gusset panels has a tab extending from an edge thereof, said edge being in parallel relationship with said longitudinal fold line.

3. A carton as defined in claim 1, wherein a tab extends from an edge of one of said side wall panels immediately adjacent said recess.

* * * * *